US005111853A

United States Patent [19]

Scruggs

[11] Patent Number: 5,111,853

[45] Date of Patent: May 12, 1992

[54] BANDING TOOL

[75] Inventor: Michael G. Scruggs, Orlando, Fla.

[73] Assignee: Daniels Manufacturing Corporation, Orlando, Fla.

[21] Appl. No.: 681,557

[22] Filed: Apr. 5, 1991

[51] Int. Cl.[5] ..... B21F 09/02

[52] U.S. Cl. ..... 140/123.6; 140/93.2; 140/150

[58] Field of Search ..... 140/93 A, 93.2, 93.4, 140/123.6, 150, 152

[56] References Cited

U.S. PATENT DOCUMENTS

| | | | |
|---|---|---|---|
| 4,410,019 | 10/1983 | Suzuki | 140/123.6 |
| 4,696,327 | 9/1987 | Wolcott | 140/150 |
| 4,928,738 | 5/1990 | Marelin et al. | 140/123.6 |
| 5,000,232 | 3/1991 | Wolcott | 140/93.4 |

*Primary Examiner*—Lowell A. Larson
*Attorney, Agent, or Firm*—James H. Beusse

[57] ABSTRACT

A banding tool for tightening a band about a woven metal braid portion of an electrical cable about a tubular termination sleeve portion of an electrical connector. The tool comprises a band tension limit which can be adjusted while the tool is coupled to a test device, such as a strain gauge. The tool includes a shuttle mechanism for incrementally advancing the band through the tool during a forward stroke. The shuttle mechanism is mechanically coupled to a pivotally mounted handle by way of an overcenter toggle mechanism. The overcenter toggle mechanism is coupled to a spring tensioning assembly, which includes a plurality of spring members, such as Belleville washers, disposed near the rear of the tool. An adjustment screw on the rear cover portion of the tool allows the spring tension of the spring members to be adjusted. Once the band tension limit is reached, the overcenter toggle mechanism locks the handle in its closed position, thereby preventing further movement of the shuttle mechanism. A lever mechanism on the tool is actuated to bend the band at approximately a 90° angle with respect to the buckle to maintain the tension in the band. The lever is operated in a reverse direction to shear the extra band at the termination.

12 Claims, 2 Drawing Sheets

BANDING TOOL

The present invention relates to manual banding tools and, more particularly, to a banding tool for assuring band tightening to within consistent predetermined tension limits.

BACKGROUND OF THE INVENTION

U.S. Pat. No. 5,000,232 describes a banding tool for tightening and receiving a band about a termination sleeve, i.e., about a woven metal braid portion of an electrical cable about a tubular termination sleeve portion of an electrical connector. The purpose of the tool is to provide a means for establishing band tension sufficient to provide a good electrical connection between the braid portion and the termination sleeve without having the tension so high that the sleeve can be damaged. The tool described in the aforementioned patent comprises a band tension limit which can be adjusted while the tool is coupled to a test device, such as a strain gauge. The manual banding tool includes a shuttle mechanism for incrementally advancing the band through the tool during a forward stroke. The shuttle mechanism is mechanically coupled to a pivotally mounted handle by way of an overcenter toggle mechanism. The shuttle mechanism includes a tensioning pawl assembly for gripping the band during a forward stroke. A retaining pawl assembly is mounted adjacent the feed track of the band and holds the tension in the band while the shuttle mechanism is in its return stroke. The overcenter toggle mechanism is coupled to a spring tensioning assembly, which includes a plurality of spring members, such as Belleville washers, disposed near the rear of the tool. An adjustment screw on the rear cover portion of the tool allows the spring tension of the spring members to be adjusted. Once the band tension limit is reached, the spring members collapse allowing the overcenter toggle mechanism to lock the handle in its closed position, thereby preventing further movement of the shuttle mechanism. The termination may then be bent by hand such that the band is at approximately a 90° angle with respect to the buckle to maintain the tension in the band. A handle operated shear is then operated to allow the termination to be removed from the tool. The outwardly extending tail portion of the band is subsequently placed adjacent the rollover assembly to allow the tail portion to be fully bent over the buckle.

In the operation of the above described banding tool, it is necessary to rotate the tool, when tension has reached a point at which the overcenter mechanism has latched, in order to bend the end of the band about a sleeve to prevent its release when the band is cut. This action necessitates a generally uncomfortable motion of an operator's arm and wrist. Thus, it would be desirable to provide a means for bending or crimping the end of a band without having to rotate the tool about the termination sleeve.

Another drawback of the above described banding tool is that the design of the tensioning mechanism is such that band tension is not consistently pulled to within preselected limits. Thus, it is desirable to provide a banding tool which assures more consistency in setting band tension. In this respect, it is also desirable to provide a band gripping mechanism which affords better gripping of a band being placed in tension. Still further, it is desirable to provide a banding tool which incorporates a readily replaceable cutting blade for severing an end of a band once a desired tension has been reached.

SUMMARY OF THE INVENTION

The above and other desirable features and advantages will be in part pointed out and in part apparent from the description to follow. In general, the present invention incorporates a mechanism in a band tensioning tool for assuring better consistency in band tensioning, a mechanism for easily bending and crimping an end of a band, and a mechanism for replacing cutting blades in such a banding tool. In accordance with the present invention, there is provided a banding tool for tightening a band about an object to a tension within preselected tension limits. The banding tool includes a housing, a reciprocal shuttle mounted in the housing for gripping a band, and a pivotable lever coupled to the shuttle and extending from the housing. Actuation of the lever causes motion of the shuttle in a direction to effect tightening of the band. A return spring is coupled to the lever to return the lever to a non-actuated position. The shuttle has a first part which supports the grip and a second part which connects to the lever arm. A spring holds the second part in a preselected position with respect to the first part. The second part is movable with respect to the first part when tension exerted on the band exceeds the instantaneous force of the spring. An overcenter linkage is connected to the lever and arranged to transition to an overcenter position when the lever is moved to a preselected end position. The shuttle is reciprocally moved a preselected distance by motion of the lever. This distance allows the linkage to retract from an overcenter position in response to force from the return spring. Relative displacement between the first and second parts of the shuttle limits reciprocal motion of the shuttle to a second distance less than the preselected distance when tension on the band is within the preselected tension limits whereby the overcenter linkage is forcibly retained in the overcenter position to prevent release of the lever to the non-actuated position.

The first part of the shuttle includes forward and aft members. The forward member has a slot extending therethrough for passage of a band. A pawl pivotally mounted to the forward member is adjacent the slot. One end of the pawl intersects the slot when the pawl is pivoted in a first direction. A linkage element connects a second end of the pawl and the aft member with a spring positioned between the forward member and the aft member for urging the members in opposite directions until restrained by the link. The pawl is pivoted in the first direction when the forward member is spaced from the aft member and the pawl is urged in a second direction for releasing a band in the slot when the aft member is urged toward the forward member.

A band cutter blade is mounted in a forward part of the housing and positioned to cut a blade. A lever pivotally mounted to the housing includes an arm which engages the cutter blade in order to drive the blade into cutting engagement with a band when the lever is pivoted in a first direction. One end of the lever extends toward an end of the housing adjacent the first part of the shuttle and engages a band inserted in the housing when the lever is pivoted in a second direction. The band is rolled over for preventing loosening by pivoting engagement with the lever end.

The cutter blade may be positioned within a guiding slot in the forward part of the housing. The lever arm engages an end of the blade distal from the cutting end. A spring mounted adjacent the blade urges the blade against the lever arm. Extending into the guiding slot is a blade retainer which restrains the blade against the spring when the lever is rotated in the second direction. The blade retainer is removable for replacement of the blade.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
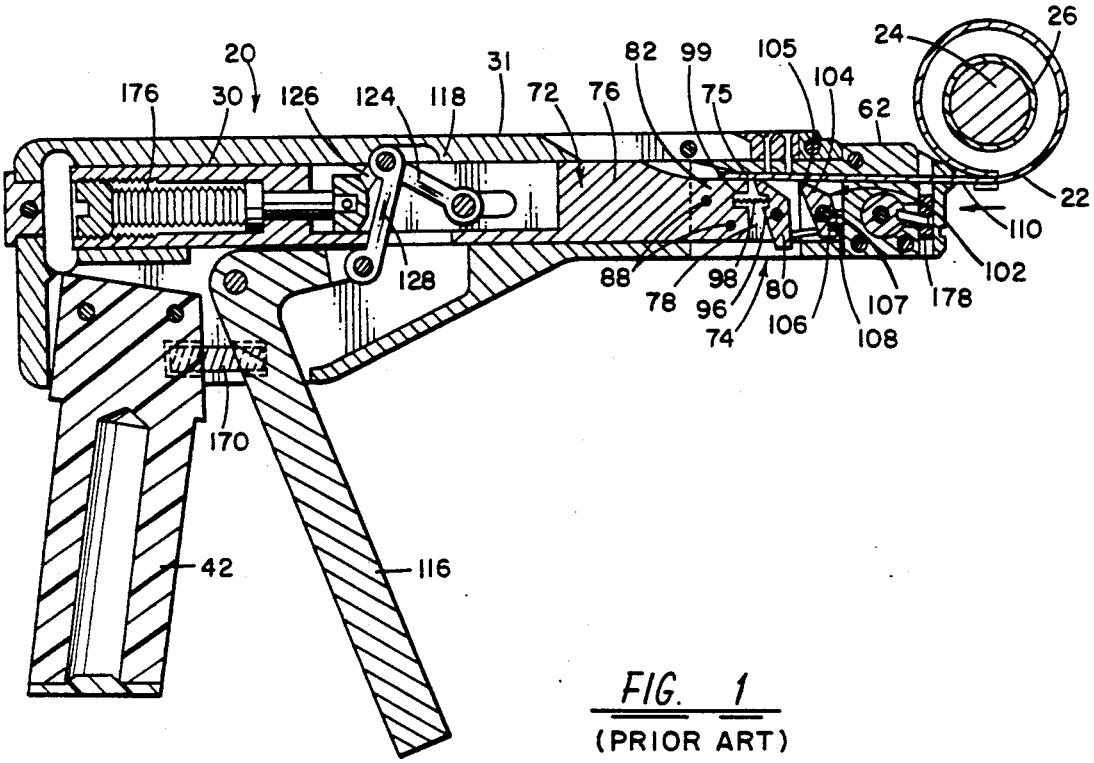
FIG. 1 (PRIOR ART)
FIG. 1 is a simplified cross-sectional view of a prior art banding tool.

Before turning to the present invention, reference is made to FIG. 1 illustrating a manual banding tool 20 of the type described in the aforementioned U.S. Pat. No. 5,000,232. The tool 20 allows a band 22 to be tightened about a tubular sleeve 24, such as a termination sleeve, formed as part of an electrical connector (not shown) or a termination sleeve on an electrical connector accessory, such as a back shell (not shown). The band 22 is often used to tightly secure a woven metal braid 26, used as an electromagnetic shield for an electrical cable, to a termination sleeve. In such an application, it is important that there be a good electrical connection between the woven metal braid 26 and the termination sleeve 24. However, it is also important that the band tension limit be such that the termination sleeve 24 is not damaged or cracked during the tightening operation. The manual banding tool 20 is provided with a spring tensioning assembly 30. The tool 20 includes a housing 31 for housing the internal components of the tool 20. A handle 42 is attached to the rear portion of the tool. A nosepiece assembly 62 is attached to the front portion of the tool.

A shuttle assembly 72, reciprocally mounted within the tool, is utilized to incrementally advance the band 22 through the tool. The shuttle assembly 72 includes a tensioning pawl assembly 74 having one or more teeth 75 disposed on one end for gripping the band 22. The shuttle assembly 72 also includes a shuttle 76, rigidly attached to a pawl retainer 78, which carries the tensioning pawl 80. The front portion of the shuttle 76 contains an extending tongue portion 82 provided with a pair of transverse apertures.

The pawl retainer 78 is a U-shaped member complementary to the extending portion 82 on the shuttle 76. The pawl retainer 78 includes a pair of apertures aligned with apertures on the shuttle assembly 72. Pins 88 are inserted through the apertures to rigidly secure the pawl retainer 78 to the shuttle 76.

The tensioning pawl 80 is pivotally connected to the pawl retainer 78 and is provided with a bore 96 for receiving a spring 98. The spring 98 is disposed in the bore 96 and into another bore 99 provided in the extending tongue portion 82 of the shuttle 76. The spring 98 biases the tensioning pawl 80. More specifically, on a forward stroke of the shuttle assembly 72, the spring 98 biases the tensioning pawl 80 such that teeth 75 grip the under surface of the band 22 and pull it through the tool. On the return stroke of the shuttle assembly 72, the tensioning pawl 80 releases the band 22.

During the return stroke of the shuttle assembly 72, the tension in the band 22 is held by a retaining pawl assembly 102. The retaining pawl assembly 102 includes a retaining pawl 104, having one or more teeth 105, pivotally mounted to the rear portion of the nosepiece assembly 62 by a pin 107. The bottom portion of the retaining pawl 102 is provided with a bore 106 for receiving a spring 108. The spring 108 biases the retaining pawl 102 in a clockwise direction.

The nosepiece assembly 62 includes a slot 110 which forms a portion of the feed path for the band 22. Once the band 22 is disposed in the feed track, the band 22 causes the retaining pawl 102 to be rotated in a counterclockwise direction. During a return stroke of the shuttle assembly 72, the teeth 105 on the retaining pawl 102 hold the tension on the band 22.

The shuttle assembly 72 is mechanically connected to a pivotally mounted lever 116 by way of an overcenter toggle assembly 118. The overcenter toggle assembly 118 is also connected to a spring tensioning assembly 30. The spring tensioning assembly 30 prevents the shuttle assembly 72 from increasing the tension in the band 22 once the band tension limit is reached.

The toggle assembly 118 also includes a downwardly extending link 128 pivotally connected to the handle lever 116. The handle lever 116 is an L-shaped member formed on the top as a clevis with the downwardly extending link 128 received between extending arm portions of the clevis.

The handle lever 116 is biased in a counterclockwise direction by a spring 170. The spring 170 is seated in a bore in the handle 42 and an aligned bore in the top portion of the handle lever 116. Before the handle lever 116 is squeezed, the tensioning pawl assembly 74 is disposed adjacent the retaining pawl 102. As the handle lever 116 is squeezed, the tensioning pawl assembly 74, attached to the shuttle assembly 74, moves toward the handle. This causes the front toggle links 124 and the rear toggle links 126 to become relatively straight with respect to each other, thus advancing the shuttle mechanism 72 rearwardly. Since the tensioning pawl assembly 74 is rigidly attached to the front portion of the shuttle assembly 72, this causes the band 22 to be advanced through the tool 20. Once the handle lever 116 is released, the spring member 170 causes the handle lever 116 to rotate in a counterclockwise direction, thus collapsing the toggle assembly 118 causing the shuttle assembly 72 to move forwardly.

In order to prevent overtensioning of a band 22, the spring tensioning assembly 30 is provided. The spring tensioning assembly is pivotally connected to the rear toggle links 126. During tightening of the band 22 at a tension well below the desired band tension limit, minimal force is applied to the spring tensioning assembly 30. However, once the tension in the band 22 exceeds the desired band tension limit, due to repeated gripping and releasing of the handle lever 116, the force applied to the spring tensioning assembly 30 will be greatly increased. Since the front toggle links 124 and the rear toggle links 126 are relatively co-linear during a forward stroke of the shuttle assembly 74, the force resulting from the gripping action will cause spring members 176 within the spring tensioning assembly 30 to collapse and prevent further movement of the shuttle assembly 74.

At the point of the stack of springs 176 collapsing, the downward link 128 is functionally pulling the rear 126 and front 124 links past their parallel condition, overcenter, effectively locking the tool in its calibrated tension setting with the handle 116 collapsed toward the handle 42.

One disadvantage of the above described tool is that the overcenter linkage 118, which is pulled into the overcenter latch condition each time that the handle lever is depressed, can be latched into the overcenter position by relatively low tension forces from spring assembly 30. For example, if the tool is adjusted to cause the spring assembly 30 to reach full compression at 150 psi, it has been found that the overcenter toggle linkage 118 can be latched at a pressure of about 70 psi. It is believed that this discrepancy arises because calibration of the tool assumes that the lever 116 will be pulled through a full stroke when slack has been taken out of the band 22 and the buckle 28 abuts the end of the tool. If slack is not removed until partway through the stroke, the full spring tension will not be reached. However, sufficient tension may be reached to prevent the lever 116 from returning to its start position and collapsing the linkage 118. Thus, while the tool user may believe that the specified tension has been placed on the band 22, such may not be true.

Among the other mentioned disadvantages, it can be seen that the band cut-off blade 178 is not readily replaceable. Also, in order to prevent the band 22 from loosening, it is necessary to bend an end of the band over the buckle 28. In the illustrated tool, it is necessary to rotate the entire tool with respect to the sleeve 24 in order to bend the band end.

Figure 2:
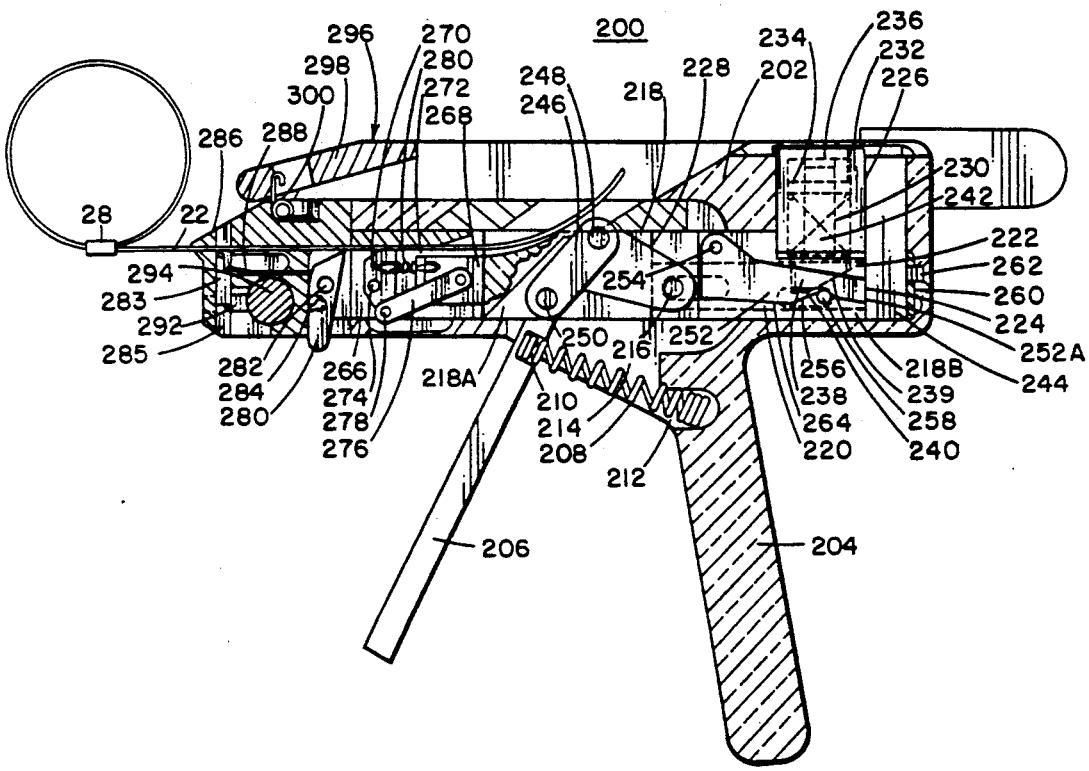
FIG. 2 is a simplified cross-sectional view of a banding tool in accordance with the present invention.

Turning now to FIG. 2, there is shown a cross-sectional view of an improved band tensioning tool 200 which overcomes the above mentioned disadvantages and others of the prior band tensioning tools. Tool 200 includes a housing 202 with a fixed handle 204 and a pivotable lever 206. A spring 208 has one end positioned in an aperture 210 in lever 206 and another end positioned in an aperture 212 in handle 204 to force lever 206 toward its normal open position as shown in FIG. 2. The lever 206 pivots within a slot 214 in housing 202 and about a pin 216 in a shuttle assembly 218.

The shuttle assembly 218 comprises a first part 218A which carries a mechanism for gripping a band 22 and a second part which is connected by pin 216 to lever 206. The part 218A includes an extension bar 220 which extends into and is slidingly engaged in a slot 222 in the part 218B. In a preferred embodiment, the bar 220 has a distal end 224 which is co-planar with end surface 226 of part 218B when the parts 218A and 218B are in abutting relationship at line 228. A spring assembly 230 is positioned within a housing 232 forming a portion of part 218B. The spring assembly 230 may comprise a plurality of Belleville washers stacked within housing 232 in a conventional manner in a well 234. An outer end of well 234 is threaded for receiving a tension adjusting screw 236. At an inner end of well 234, the spring assembly 230 reacts against a block 238 positioned within a slot 240 in bar 220. The block 238 includes an attached shaft 242 which extends upward and forms a guide post for supporting the Belleville washers within well 234.

A lower surface of block 238, as viewed in FIG. 2, is formed with an inclined surface, preferably at about 30 degrees although it is believed that the surface angle could vary from about 20 degrees to about 45 degrees depending on the effect of friction and selected spring strengths used in the tool. The slot 240 includes a mating surface matching the inclined surface on block 238 at line 239 which tends to drive bar 220 toward the rear or right-end of tool 200 as viewed in FIG. 2. Since the spring assembly 230 and block 238 are restrained within shuttle part 218B while bar 220 is connected to part 218A, the spring assembly 230 forms a spring means for holding the part 218A in a preselected position with respect to part 218B.

The lever 206 is connected to part 218B at pin 216 and is operative to drive part 218B toward the rear of housing 202 each time the lever is squeezed against handle 204. The space 244 represents the available travel distance of shuttle assembly 218. So long as the tension exerted on part 218A is less than the tension of spring assembly 230, the parts 218A and 218B will travel or reciprocate as a whole. If the tension on part 218A caused by pulling or tightening of band 22 reaches or exceeds the force of spring assembly 230, then separation between parts 218A and 218B will occur as spring assembly 230 is compressed by relative movement of bar 220 to the left causing block 238 to climb the inclined surface. The upper end of lever 206 is generally L-shaped with a toggle link 246 pivotally pinned at pin 248 at about the corner of the L-shape. A second end of link 246 is pivotally attached to housing 202 at pin 250. As the lever 206 is pivoted counterclockwise toward handle 204 pivoting about pin 216, the link 246 pivots about pin 250 forcing the connection at pin 248 to move toward the rear of the tool thus driving the part 218B in a rearward direction.

At each full squeeze or closure of lever 206 against handle 204, the link 246 is pivoted about pin 250 such that pin 248 is below a line extending between pin 250 and pin 216, i.e., the linkage assembly of link 246 and lever 206 transitions into an overcenter position. However, the force exerted by spring 208 is sufficient to normally return the lever 206 to its rest position as shown in FIG. 2. If the part 218A is at least partially separated from part 218B due to tension in band 22, the lever 206 will be returned to its rest position by spring 208 since the action of spring assembly 230 tends to drive part 218B toward part 218A. In order to hold the lever 206 in a closed position, i.e., to maintain link 246 overcenter when the full desired tension has been placed on band 22, there is provided a cam lever 252 pivotally mounted to part 218B at pin 254. The cam lever 252 includes an inclined plane at 256 which rides on a pin 258 affixed to bar 220. The inclination of the inclined plane is such as to cause cam lever 252 to rotate counterclockwise about pin 254 when part 218A separates from its abutting position with part 218B. Preferably, the inclined plane 256 extends at a first preselected angle of about 30° with respect to the direction of motion of the shuttle assembly 218, although it is believed that angles between about 20° and 45° will allow operation of lever 252. The length of cam lever 252 is selected such that an end 252A extends a preselected distance from beyond end surface 226 when part 218B reaches about its maximum separation from part 218A. The separation of part 218A from part 218B is limited to a distance slightly less than maximum by interference between end 252A and a wear plate 260 attached to and positioned within a receptacle formed in an inner surface of housing 202. Plate 260 may be held in place by a screw 262 threadedly engaging the plate through an aperture in housing 202.

The extension of cam lever end 252A beyond surface 226 is selected to place an additional pressure on the overcenter linkage assembly so that a slightly increased force is required on lever 206 to drive pin 248 to its overcenter position. At the same time, the cam lever 252 is so arranged that inclined plane 256 rides up and over pin 258 so that lever 252 is supported on pin 258 at surface 264 which has a much shallower angle than surface 256. Preferably, the surface 264 extends at a second preselected angle of about 5° with respect to the direction of motion of shuttle assembly 218. In effect, cam lever 252 is jammed between pin .258 and spring assembly 230 with the angle of surface 264 inhibiting the action of spring assembly 230 in urging part 218B toward part 218A so that spring 208 is unable to force lever 206 to drive the linkage out of the overcenter position.

The unique action of the shuttle assembly 218 in being latched only when the separation between parts 218A and 218B reach about the preselected maximum positioned assures that the band 22 is brought to within preselected tolerance levels of the selected tension when the lever 206 latches. If the separation between parts 218A and 218B is less than about the selected maximum, which will occur if both shuttle parts reciprocate a small amount prior to band 22 tension causing the spring assembly 230 to effect separation of the parts, then the cam lever 252 will not ride fully up on pin 258 and the springs 208 and 234 will cause lever 206 to be pivoted clockwise and the link 246 to move out of the overcenter position.

The operation of the above described improvement assures that proper tension is placed on a band 22. During calibration of the tool 200 or the tool 20, care is generally taken to assure that a full stroke of lever 206 or 116 occurs on the calibration stroke, i.e., the band 22 and buckle 28 are pulled so that slack is removed and the buckle abuts the tool end. In general use, operators are not always so careful resulting in tension being pulled only on part of a stroke so that full tension set by the spring assembly is not reached. In the present invention, the tool 200 releases the overcenter linkage if a full stroke does not occur since cam lever 252 will not rotate to its maximum position to inhibit spring assembly 230 and to jam the link 246.

Turning now to the band grasping mechanism, which assures positive restraint of band 22, the forward part 218A of shuttle assembly 218 includes a forward member 266 and an aft member 268. The forward member 266 carries a band engaging pawl 270 pivotally mounted adjacent a slot 272 through which an end of band 22 passes. The pawl 270 is mounted at approximately its center by a pin 274 in the shuttle assembly 218. A lower end of pawl 270 is pivotally coupled to one end of a link 276 by pin 278. Another end of link 276 is pivotally connected to an aft member 268. A spring 280 is captured between an upper end of pawl 270 and an adjacent aperture in member 268 thus pushing pawl 270 in a counterclockwise direction about pin 278. It will be noted that the only connection between forward and aft members 266 and 268 is through link 276. Aft member 268 can be treated as the driven portion of part 218A since bar 220 is an extension of member 268. Therefore, when lever 206 is actuated, member 268 moves rearwardly pulling link 276 and pivotally driving pawl 270 into band 22, as compared to prior tools which relied only on the engagement between the band and pawl edge to drive the pawl into the band. The band engaging end of pawl 270 is generally arcuately shaped with a plurality of teeth on the upper arcuate surface for engaging the band at multiple points. The arcuate shape is offset with respect to pin 278 so that increased force is exerted on band 22 by pawl 270 with increased force pulling on member 268. However, as lever 206 is released and shuttle assembly 218 moved forwardly, the pawl 270 is pivotally urged clockwise to release band 22 and allowing the pawl 270 to slip forwardly over the band surface. The pawl 270 is connected to linkage element 276 by a pin 278 extending laterally to each side of the pawl. A slot is formed in the forward part 218A for receiving pin 278 such that relative movement between part 218A and part 268 is limited by the dimensions of the slot.

Since the forward motion of shuttle assembly 218 releases band 22, there is provided a second pawl 280 in the forward part of housing 202 for holding at least some tension in band 22 while pawl 270 is sliding forward to re-grip the band. Pawl 280 is pivotally mounted to housing 202 at pin 282. A spring 284 positioned in an aperture in pawl 280 operates against an adjacent housing surface to urge pawl 280 generally counterclockwise and in engagement with band 22. Pawl 280 may have only a single edge to grip band 22 since its function is to hold only a limited tension in band 22 while pawl 270 is positioned to grip the band. However, the two pawls 270 and 280 will be seen to work in conjunction to assure that a final stroke of lever 206 will begin with all slack removed from band 22 and with at least a minimum amount of tension on the band so that the tool is effective to pull the preselected amount of tension on the band.

Figure 3:
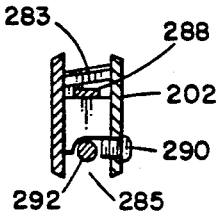
FIG. 3 is a view of a cutting blade retention assembly for the tool of FIG. 2.

Another feature of the tool 200 is the cut-off blade 283 positioned in slot 285 adjacent an end 286 of the tool. Slot 285 guides the blade 283. A cantilever or leaf spring 288 holds blade 283 in a retracted position, reacting against a pre-formed shoulder on the blade. A screw 290 (see FIG. 3) threadedly engages housing 202 and enters slot 285 below the blade 283, thus retaining the blade in the slot against spring 288. The blade 283 is driven upward against the spring 288 into a cutting position by an arm 292 connected to pivotable shaft 294. The shaft 294 extends through housing 202 and is connected to band cut-off and crimping lever 296. The lever 296 is manually operated by rotation in a clockwise direction to force arm 292 to drive blade 283 into cutting engagement with band 22. While this operation is similar to that described in U.S. Pat. No. 5,000,232, the lever 296 is also rotatable in a counterclockwise direction to remove arm 292 from slot 285. With arm 292 removed, screw 290 can be removed allowing blade 283 to fall from slot 285 for replacement, thus greatly simplifying blade removal and replacement.

It will also be noted that lever 296 includes a rounded nose portion 298 which, when lever 296 is rotated counterclockwise, will engage band 22 forcing the band and associated terminal sleeve to bend about end 286 of tool 200 without having to hold the terminal sleeve while rotating the tool. Thus, the tool 200 includes means for crimping the band 22 about buckle 28 and minimizes the potential for wrist injury due to repetitive rotation of the tool per se. The lever 296 is spring biased into the position shown in FIG. 2 by a torsion spring 300 which forces the lever in a counterclockwise direction and a second torsion spring (not shown) mounted about shaft 294 which forces the lever in a clockwise direction.

While the principles of the invention have now been made clear in an illustrative embodiment, it will become apparent to those skilled in the art that many modifications of the structures, arrangements, and components presented in the above illustrations may be made in the practice of the invention in order to develop alternate embodiments suitable to specific operating requirements without departing from the spirit and scope of the invention as set forth in the claims which follow.

What is claimed is:

1. A banding tool for tightening a band about an object to a tension within preselected tension limits, the tool including:

a housing;

a reciprocal shuttle mounted in the housing and including means for gripping a band;

a pivotable lever coupled to the shuttle and extending from the housing, actuation of the lever being effective to cause motion of said shuttle in a direction to effect tightening of the band, a return spring being coupled to said lever to return said lever to a non-actuated position;

said shuttle having a first part for supporting said gripping means and a second part connected to said lever arm, spring means for holding said second part in a preselected position with respect to said first part, said second part being movable with respect to said first part when the tension exerted on the band exceeds the instantaneous force of said spring means;

an overcenter linkage connected to said lever and arranged to transition to an overcenter position when said lever is moved to a preselected end position, said shuttle being reciprocally movable a preselected distance by motion of said lever, said distance allowing said linkage to retract from an overcenter position in response to force from said return spring; and means responsive to relative displacement between said first part and said second part of said shuttle for limiting reciprocal motion of said shuttle to a second distance less than said preselected distance when tension on the band is within the preselected tension limits whereby said overcenter linkage is forcibly retained in said overcenter position to prevent release of said lever to said non-actuated position.

2. The banding tool of claim 1 wherein said means for limiting reciprocal motion of said shuttle comprises a cam lever having a first end pivotally mounted to said second part and a second end extending beyond an end of said second part when said cam lever is in a first position, said second end of said cam lever being generally coextensive with said end of said second part when said cam lever is in a second position, and said tool including cam means operable in response to displacement between said first part and said second part for urging said cam lever from said second position to said first position, said second end of said cam lever abutting a surface of said housing when said cam lever is in said first position for limiting motion of said shuttle.

3. The banding tool of claim 2 wherein said first part of said shuttle includes an extension bar slidingly positioned with a mating slot in said second part of said shuttle, said cam means comprising a pin attached to said extension bar for movement therewith, said cam lever having a first surface formed at a first preselected angle and positioned to ride on said pin and a second surface extending from said first surface at a second preselected angle and positioned to engage said pin when said cam lever is substantially in said first position.

4. The banding tool of claim 3 wherein said first preselected angle is between about twenty degrees and about forty-five degrees with respect to the direction of motion of said shuttle.

5. The banding tool of claim 3 wherein said second preselected angle is about five degrees.

6. The banding tool of claim 3 and including a slot formed adjacent a distal end of said extension bar, one side of said slot being formed with an inclined surface at a preselected angle with respect to the direction of motion of said shuttle, a block retained in said slot, said block having one surface adapted for mating with said inclined surface such that movement of said extension arm forces said block to rise on said inclined surface and be displaced generally perpendicularly to the direction of motion of said extension bar, said spring means being positioned to react against said block to inhibit motion thereof to thereby exert a spring force tending to resist displacement of said extension bar with respect to said second part of said shuttle.

7. The banding tool of claim 1 wherein said first part of said shuttle includes a forward member and an aft member, the forward member having a slot extending therethrough for passage of a band, a pawl pivotally mounted adjacent said slot, one end of said pawl intersecting said slot when said pawl is pivoted in a first direction, a linkage element connected between a second end of said pawl and said aft member and a spring positioned between said forward member and said aft member for urging said members in opposite directions until restrained by said link, said pawl being pivoted in said first direction when said forward member is urged away from said aft member for driving said pawl into the band through said link, and said pawl being urged in a second direction for releasing a band in said slot when said aft member is urged toward said forward member.

8. The banding tool of claim 7 wherein said pawl is connected to said linkage element by a pin extending laterally to each side of said pawl, a second slot formed in said forward member for receiving said pin whereby relative movement between said forward and aft members is limited by dimensions of said second slot.

9. The banding tool of claim 7 wherein said one end of said pawl is arcuately shaped, a surface of said one end having a plurality of spaced teeth for engaging a band inserted in said slot.

10. The banding tool of claim 1 and including a band cutter blade mounted in a forward part of said housing and positioned for cutting a band, a lever pivotally coupled to said housing and including an arm for engaging said cutter blade and driving said blade into cutting engagement with a band when said lever is pivoted in a first direction, one end of said lever extending toward an end of said housing adjacent said forward part thereof, said one end of said lever engaging a band inserted in said housing when said lever is pivoted in a second direction, the band being rolled over for preventing loosening by pivoting engagement with said lever end.

11. The banding tool of claim 10 and including a first spring means coupled between said lever and said housing for urging said lever in said first pivoting direction and second spring means for restraining said lever at a preselected position prior to engagement of said arm with said cutter blade.

12. The banding tool of claim 10 wherein said cutter blade is positioned within a guiding slot in said first part of said shuttle, said lever arm engaging an end of said blade distal from a cutting end thereof, spring means mounted adjacent said blade and operative to urge said blade against said lever arm, and blade retaining means extending into said guiding slot for restraining said blade against said spring when said lever is rotated in said second direction, said blade retaining means being removable for replacement of said blade.

* * * * *